United States Patent [19]

Wochnowski et al.

[11] 3,974,839

[45] Aug. 17, 1976

[54] CONDITIONING OF TOBACCO

[75] Inventors: Waldemar Wochnowski; Uwe Leckband; Hans-Heinrich Barth, all of Hamburg; Reinhard Hohm, Hamburg-Bahrenfeld, all of Germany

[73] Assignee: Hauni-Werke Korber & Co., KG, Hamburg, Germany

[22] Filed: Nov. 18, 1974

[21] Appl. No.: 524,929

Related U.S. Application Data

[62] Division of Ser. No. 297,868, Oct. 18, 1972, Pat. No. 3,877,469.

[30] Foreign Application Priority Data

Oct. 19, 1971 Germany ..... 2151844
Mar. 11, 1972 Germany ..... 2211879

[52] U.S. Cl. ..... 131/136
[51] Int. Cl.[2] ..... A24B 3/06
[58] Field of Search ..... 131/134, 135, 136, 140, 131/138

[56] References Cited

UNITED STATES PATENTS

| | | | |
|---|---|---|---|
| 3,399,462 | 9/1968 | Koch et al. | 131/136 X |
| 3,482,162 | 12/1969 | Wochnowski | 131/136 X |
| 3,799,176 | 3/1974 | Wochnowski | 131/135 |
| 3,881,498 | 5/1975 | Wochnowski | 131/134 |

*Primary Examiner*—Robert W. Michell
*Assistant Examiner*—V. Millin
*Attorney, Agent, or Firm*—Peter K. Kontler; John Kurucz

[57] ABSTRACT

The particles of a continuous tobacco stream are conditioned during transport through a vibratory conveyor having a bottom wall located above a stationary chamber which receives conditioned air from one or more blowers. The bottom wall is formed with apertures through which the air passes across the tobacco stream in the form of pulsating currents which agitate the particles of the stream to insure a pronounced energy exchange between tobacco particles and air. The currents pulsate due to vibration of the bottom wall relative to the chamber, and the latter is provided with transversely extending baffles which insure that the tobacco stream is traversed by air currents having different intensities. The same result can be achieved by forming the bottom wall with larger and smaller apertures. The vibratory conveyor has two sections in the first of which the particles of tobacco are contracted by air having a temperature and moisture content corresponding to the desired temperature and moisture content of conditioned tobacco. The air which has been used for heating of tobacco in the first conveyor section is intercepted and is thereupon conditioned prior to admission into the second conveyor section.

9 Claims, 5 Drawing Figures

101
162
107
161
161
152
108
157
108
153
157
A
109
111
117

CONDITIONING OF TOBACCO

This is a division of application Ser. No. 297,868, filed Oct. 18, 1972, now U.S. Pat. No. 3,877,469.

BACKGROUND OF THE INVENTION

The present invention relates to conditioning of tobacco in general, and more particularly to improvements in a method of changing the moisture content of tobacco. Still more particularly, the invention relates to improvements in a method of conditioning tobacco by contact with a gaseous conditioning medium, preferably air.

It is customary to increase the moisture content of tobacco prior to certain treatments to which the tobacco is subjected preparatory to introduction into a machine for the making of cigars, cigarillos or cigarettes. The increased moisture content is desirable in order to enhance the suppleness or pliability of tobacco and to reduce the likelihood of generation of tobacco dust and/or excessive fragmentizing of tobacco. It is also customary to mix tobacco with a suitable casing which is added to improve the aroma and/or other characteristics of the filler in a rod-shaped smokers' product or the characteristics of pipe tobacco. The excess of moisture must be withdrawn from tobacco prior to conversion into fillers of cigarettes, cigars or the like or prior to introduction of pipe tobacco into bags, boxes or other receptacles. For example, the moisture content of tobacco shreds which are to be introduced into a modern high-speed cigarette making machine must be maintained within an extremely narrow range. As a rule, the actual moisture content should not deviate from a desirable optimum moisture content by more than a small fraction of one percent. Thus, the conditioning of tobacco prior to introduction into a consuming machine must be carried out with great care in order to insure that the actual moisture content will be the same as the optimum moisture content for further processing.

SUMMARY OF THE INVENTION

An object of the invention is to provide a novel and improved method of conditioning large quantities of tobacco (such as tobacco leaves, tobacco leaf laminae, a mixture of laminae and ribs or stem, or tobacco shreds) per unit of time in a small area and in such a way that the ultimate characteristics of tobacco at least closely approximate the desirable optimum characteristics.

Another object of the invention is to provide a novel and improved method of reducing the moisture content of tobacco which forms a continuously moving stream so that the ultimate moisture content closely approximates or matches the desired moisture content.

A further object of the invention is to provide a novel and improved method of conditioning a continuous stream of tobacco with currents of air.

The tobacco conditioning method of our invention comprises the steps of conveying a continuous stream of tobacco particles along a predetermined path which is preferably wide enough to allow for transport of tobacco in the form of a carpet, and passing across the path pulsating currents of a gaseous fluid, preferably air, whereby the particles of tobacco exchange energy with the gaseous fluid. The method preferably further comprises the step of vibrating the particles of tobacco during contact with the currents of gaseous fluid so that the fluid contacts an agitated body of tobacco particles. The pulsating currents of gaseous fluid can be generated as a result of vibration of the particles of tobacco; thus, the conveyor which defines the path for the tobacco stream can cause repeated compression of a supply of gaseous fluid so that the fluid is caused to form a plurality of pulsating currents by passing upwardly through an apertured bottom wall of the conveyor which overlies the supply of gaseous fluid. The currents are preferably caused to pass at least substantially at right angles to the direction of tobacco travel along the predetermined path.

The currents preferably include at least one first group of currents of gaseous fluid flowing at a first speed and at least one second group of currents flowing at a different second speed. Also, the currents may include at least one first group of currents having a first intensity and at least one second group of currents having a different second intensity. This can be achieved by causing the currents to flow through apertures of different sizes so that the currents of the first group have first cross-sectional areas and the currents of the second group have different second cross-sectional areas. The currents are preferably distributed across the full width of the path for tobacco particles.

The path for tobacco particles preferably includes a first portion and a second portion. The currents then form a first group or set of currents passing across the first portion of the path and a second group of currents passing across the second portion of the path. The method then preferably comprises the additional steps of heating one of the groups of currents to a predetermined temperature exceeding the temperature of tobacco particles in the respective portion of the path, and maintaining the temperature and the moisture content of the other group of currents at a predetermined value preferably corresponding to or matching the desired final temperature and moisture content of tobacco. The gaseous fluid of the one group of currents can be intercepted after having passed across the tobacco stream in the first portion of the path, and the thus intercepted gaseous fluid is used to form the other group of currents.

At least some of the currents may be decelerated immediately subsequent to their passage across the tobacco stream to prevent the gaseous fluid from entraining tobacco particles, especially lighter tobacco particles, from the path.

The novel features which are considered as characteristic of the invention are set forth in particular in the appended claims. The conditioning apparatus itself, however, both as to its construction and its mode of operation, will be best understood upon perusal of the following detailed description of certain specific embodiments with reference to the accompanying drawing.

DESCRIPTION OF THE PREFERRED EMBODIMENTS

Figures 1, 2:
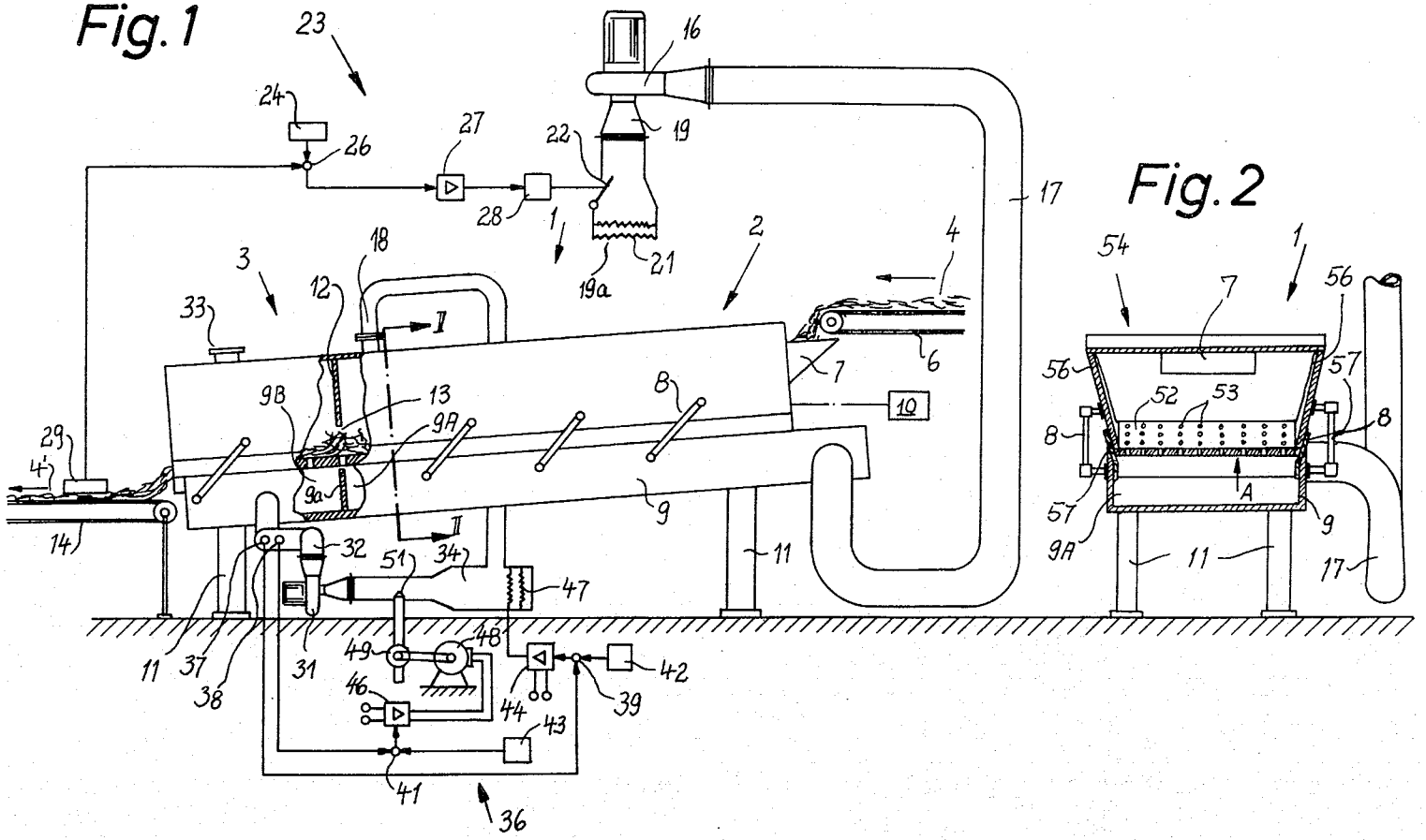
FIG. 1 is a partly elevational and partly longitudinal vertical sectional view of a first conditioning apparatus.
FIG. 2 is a transverse vertical sectional view as seen in the direction of arrows from the line II—II of FIG. 1.

The tobacco conditioning apparatus of FIGS. 1 and 2 comprises a vibratory conveyor 1, a feeding conveyor 6 which supplies a continuous stream of tobacco particles 4 to the vibratory conveyor 1, and a receiving conveyor 14 which transports conditioned tobacco 4', to a further processing station, not shown. The vibratory conveyor 1 comprises a first section 2 which receives tobacco particles 4 from the feeding conveyor 6 by way of an inclined chute 7, and a second section 3 which receives heated tobacco particles from the section 2 and delivers conditioned tobacco 4, to the receiving conveyor 14. During transport by the conveyor section 2, the particles of tobacco 4 are subjected primarily to a drying or moisture expelling action. The thus dried tobacco is thereupon subjected to a further treatment during transport by the section 3 to establish a hygroscopic balance or equilibrium between its particles and the atmosphere around it.

The sections 2 and 3 of the vibratory conveyor 1 are mounted on pairs of leaf spring 8 which are in turn mounted on a stationary chamber 9 supported by upright frame members or columns 11. The conveyor sections 2 and 3 are partially separated from each other by a transverse partition 12 which is provided with an opening 13 for passage of dried tobacco particles 4 from the section 2 into the section 3.

The drying medium for tobacco is a gaseous fluid, preferably air, which is fed into the rear portion of the chamber 9 by a conduit 17 connected to the outlet of a blower 16. The intake end of the blower 16 is connected with a pipe 19 which contains an electric resistance heater 21 and is provided with an adjustable valve 22. The conduit 17 is connected with the rear end portion of the chamber 9 so that the heated air which is conveyed by the blower 16 flows across the path of tobacco particles 4 in the section 2 and is evacuated by way of an intercepting conduit 18 connected to the casing of the conveyor section 2 upstream of the partition 12.

The position of the valve 22 determines the temperature of air which enters the chamber 9 by way of the conduit 17. Thus, the blower 16 draws air into the pipe 19 at the open end 19*a*, and such air is heated by the resistance heater 21. The valve 22 can admit varying amounts of unheated atmospheric air which is mixed with heated air on its way into the chamber 9.

A control unit 23 which can change the position of the valve 22 to thereby regulate the temperature of air in the conduit 17 comprises a rated value selector 24 (e.g., a potentiometer) which is connected with a signal comparing junction 26. The latter is further connected with an amplifier 27 serving to control a servomotor 28 for the valve 22. The junction 26 is also connected with a moisture detector 29 which is adjacent to the receiving conveyor 14 and furnishes signals indicating the moisture content of successive increments of conditioned tobacco 4'. The moisture detector 29 may be a device known as HWK produced by the West-German Firm Hauni-Werke, Korber & Co. K.G., Hamburg-Bergedorf.

The partition 12 is in substantial register with a transverse partition 9*a* which subdivides the interior of the stationary chamber 9 into a rear compartment 9A below the conveyor section 2 and a front compartment 9B below the conveyor section 3. The conduit 17 discharges heated air into the rear compartment 9A. The front compartment 9B receives treated air by way of a pipe 32 connected to the outlet of a second blower 31 whose inlet pipe 34 is connected with the discharge and of the intercepting conduit 18. Thus, the blower 31 can force across the tobacco layer in the conveyor section 3 that body of air which has been withdrawn from the compartment 9A after having passed across the tobacco layer in the conveyor section 2. The air which has been caused to pass across the tobacco layer in the section 3 can escape into the atmosphere by way of an outlet 33 in the casing of the conveyor section 3.

The condition of the air current entering the front compartment 9B of the chamber 9 is monitored and regulated by a second control unit 36 which comprises two detectors 37 and 38 mounted in the pipe 32 connecting the blower 31 with the compartment 9B. The detector 37 is a thermoelement or a heat-sensitive conductor of the type known as NTC or PTC, and serves to furnish signals indicating the temperature of air which flows into the compartment 9B. The detector 38 is a hygrometer which furnishes signals representing the moisture content of air which is being forced to enter the compartment 9B. The output of the detector 37 is connected with a signal comparing junction 39 which is further connected with a rated value selector 42 and with an output amplifier 44 controlling an electric resistance heater 47 in the pipe 34. The output of the detector 38 is connected with a signal comparing junction 41 which is further connected with a rated value selector 43 and transmits signals to an output amplifier 46 which controls the speed of an electric motor 48 serving to drive a variable delivery pump 49 which draws water from a suitable source and conveys water to one or more spray nozzles 51 which discharge atomized water into the air flowing from the intercepting conduit 18 toward the blower 31. In the illustrated embodiment, the nozzle or nozzles 51 discharge atomized liquid into the pipe 34.

FIG. 2 shows that the vibratory conveyor 1 comprises a casing which is common to the sections 2, 3 and includes a gas-permeable stepped tobacco supporting member or bottom wall 52 provided with apertures 53, and a cover portion or cap 54. The apertures 53 are small bores or holes of circular outline. The bottom wall 52 preferably consists of sheet metal. The side walls 56 of the cover portion 54 diverge in a direction upwardly and away from the bottom wall 52.

The upper side of the chamber 9 is open so that air which enters the compartments 9A and 9B can flow upwardly through the apertures 53 in the adjacent portions of the supporting member or bottom wall 52. In order to prevent uncontrolled escape of air from the compartments 9A and 9B, the vibratory conveyor 1 further comprises elastic sealing rails 57 which allow the bottom wall 52 to vibrate relative to the adjacent side walls of the chamber 9. The means for vibrating the bottom wall 52 and cover portion 54 is shown at 10. The arrow A indicates in FIG. 2 the direction of air flow from the compartment 9A, through the apertures 53 in the adjacent portion of the bottom wall 52, and into the space within the rear part of the cover portion 54 for entry into the intercepting conduit 18.

When the vibrator 10 is on, the bottom wall 52 performs recurrent movements relative to the stationary chamber 9 and acts not unlike a diaphragm which causes the air currents flowing through the apertures 53 to pulsate and to thus enhance the exchange of heat between heated air and the particles 4 of the tobacco stream on the bottom wall 52. The air currents flowing through the apertures 53 pulsate at the frequency of vibratory movement of the bottom wall 52. The chamber 9 can be said to constitute a pulse generator for the currents of air which pass through the apertures 53.

The apertures 53 are preferably circular bores or holes each having a diameter which approximates the thickness of the bottom wall 52. The combined cross-sectional area of all apertures 53 need not exceed and is preferably less than one-fourth of the tobacco-supporting area of the bottom wall 52. Such dimensioning of apertures 53 insures highly satisfactory agitation, drying and conditioning of tobacco with economical utilization of gaseous fluid.

The currents of air passing upwardly through the apertures 53 at right angles to the direction of travel of tobacco particles 4 will be caused to pulsate if the casing of the conveyor 1 is stationary and the device 10 is used to vibrate one side panel or wall or the bottom panel or wall of the chamber 9. The vibrated panel or wall of the chamber 9 then performs one function of the vibrating bottom wall 52, i.e., it acts as a diaphragm to effect periodic compression of air in the compartments 9A and 9B. The device 10 can vibrate the casing of the conveyor 1 and one or more walls of the chamber 9.

The operation:

The feeding conveyor 6 supplies a continuous stream of tobacco particles 4 into the chute 7 which discharges tobacco onto the bottom wall 52 in the conveyor section 2 above the compartment 9A. The vibrator 10 imparts to the bottom wall 52 and cover portion 54 recurrent oscillatory movements which, combined with slight downward inclination of the bottom wall 52 in a direction from the conveyor 6 toward the conveyor 14 and with stepped configuration of the bottom wall 52, cause successive increments of the tobacco stream to advance toward, through and beyond the opening 13 in the partition 12.

The blower 16 supplies into the compartment 9A a stream of heated air by way of the conduit 17. This stream is divided into a large number of currents or streamlets during passage through the apertures 53 and the currents flow across the tobacco layer in the conveyor section 2 to leave the section 2 by way of the intercepting conduit 18. Vibratory movements of the bottom wall 52 cause the particles 4 of the tobacco layer in conveyor section 2 to rise and fall whereby the particles are intermittently lifted above and thereupon repeatedly descend onto the upper side of the bottom wall 52. When the bottom wall 52 moves downwardly, it compresses the supply of air in the compartment 9A so that the speed of tobacco currents flowing through the apertures 53 increases with the result that the pulsating currents lift the tobacco particles 4 above the bottom wall 52. In other words, the particles 4 of tobacco in the conveyor section 2 float at times above the bottom wall 52 which promotes the exchange of heat between tobacco and heated air. At the same time, the pulsating currents of heated air bring about a pronounced loosening of tobacco so that the particles 4 are separated from each other and that each side of each particle 4 comes into satisfactory heat-exchanging contact with the surrounding atmosphere. It was found that the just described energy exchange between tobacco and air is much more satisfactory than in conveyors which are not caused to vibrate and which are not traversed by pulsating currents of heated air.

Since the side walls 56 of the cover portion 54 of the conveyor casing diverge in a direction upwardly and away from the bottom wall 52, the cross-sectional area of the space within the cover portion 54 increases in the same direction with the result that the currents of air are decelerated during flow toward the inlet of the intercepting conduit 18. This is desirable because the decelerated currents of air are unable to entrain tobacco particles, including the lighter and lightest particles, into the conduit 18.

The thus heated tobacco particles 4 enter the conveyor section 3 by way of the opening 13 in the partition 12 and are conditioned by air which flows from the compartment 9B, through the apertures 53 of the bottom wall 52 above the compartment 9B, and toward the outlet 33. The condition of air which is supplied by the blower 31 (namely, the temperature and moisture content of such air) preferably corresponds exactly to the desired condition of tobacco 4' on the receiving conveyor 14. Thus, the treatment in the conveyor section 3 should establish an exact hygroscopic balance between the particles 4 of the tobacco stream and the surrounding atmosphere. This insures that the moisture content of all tobacco particles leaving the vibratory conveyor 1 corresponds to a desired moisture content which is best suited for further processing of tobacco. For example, the tobacco particles 4 may constitute tobacco leaves or tobacco leaf laminae which are to be shredded downstream of the receiving conveyor 14.

The detector 37 monitors the temperature of air which is supplied by the blower 31 and transmits corresponding signals to the junction 39. Such signals are compared with the signal furnished by the rated value selector 42 e.g., a potentiometer which can be adjusted to furnish a signal representing the desired temperature of air in the compartment 9B), and the junction 39 causes the heating device 47 to raise or lower the temperature of air in the pipe 34 if the signal furnished by the detector 37 deviates from the signal which is furnished by the potentiometer 42.

The detector 38 monitors the moisture content of air which flows into the compartment 9B and transmits appropriate signals to the junction 41 which compares such signals with the signal from the rated value selector 43. The latter is set to transmit a signal indicating the desired moisture content of air. If the signal from 38 deviates from signal which is furnished by the selector 43, the junction 41 transmits a signal which causes the amplifier 46 to change the speed of the motor 48 so that the pump 49 delivers to the nozzle or nozzles 51 a different quantity of water for atomization is the interior of the pipe 34. The detectors 37, 38 cooperate to insure that the temperature and moisture content of air entering the compartment 9B invariably remain within a narrow range to thus insure that the temperature and moisture content of tobacco 4' at least closely approximate an optimum temperature and an optimum moisture content.

Since the blower 31 draws air from the intercepting conduit 18, the air which is to be conditioned by the heater 47 and nozzle or nozzles 51 has undergone a preliminary conditioning treatment which reduces the energy requirements of the control unit 36. Furthermore, such reusing of air which is being evacuated from the conveyor section 2 reduces the overall air requirements of the conditioning apparatus with attendant savings in energy.

Otherwise, the treatment of tobacco particles 4 with air which passes from the compartment 9B into the conveyor section 3 and escapes via outlet 33 is the same as the treatment with air which is supplied by the compartment 9A. In other words, the pulsating currents of air passing through the apertures 53 bring about a loosening of tobacco and repeatedly lift the tobacco particles above the bottom wall 52 to insure a more pronounced exchange of heat and moisture between air and tobacco.

The detector 29 monitors the final moisture content of tobacco 4' on the receiving conveyor 14. If such moisture content deviates from a predetermined moisture content (see the selector 24), the signal from the detector 29 causes the junction 26 to transmit a signal to the servomotor 28 by way of the amplifier 27 whereby the servomotor 28 changes the position of the valve 22 to thus change the temperature of air in the compartment 9A. It will be noted that the control unit 23 serves to change the temperature of air in the compartment 9A and conveyor section 2 as a function of deviations of final moisture content of tobacco 4' from the moisture content selected by the device 24.

Figure 3:
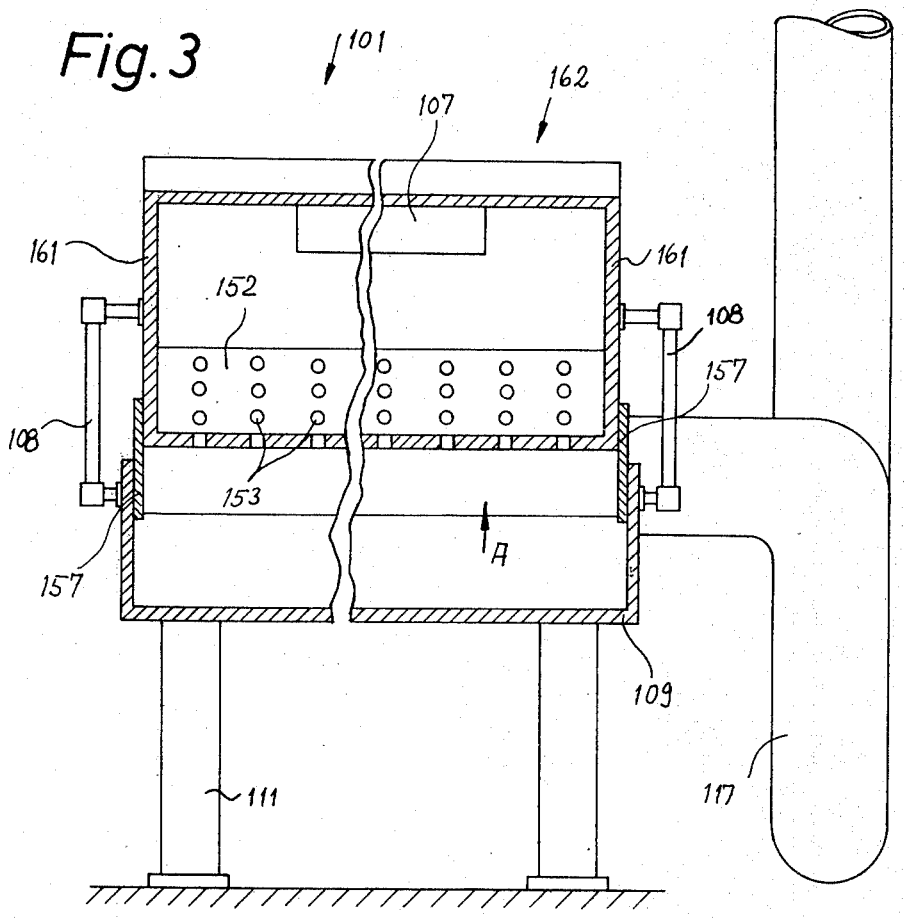
FIG. 3 is a similar transverse vertical sectional view of a second conditioning apparatus.

FIG. 3 illustrates a portion of a second conditioning apparatus wherein all such parts which are identical with or clearly analogous to the corresponding parts of the apparatus shown in FIGS. 1 and 2 are denoted by similar reference characters plus 100. The main difference is that the side walls 161 of the cover portion 162 of the casing of the vibratory conveyor 101 do not diverge in a direction upwardly and away from the gas-permeable supporting member or bottom wall 152. Thus, the width of the casing of the conveyor 101 is at least substantially constant and corresponds to the width of the bottom wall 152. The width of the bottom wall 152 exceeds the width of the bottom wall 52 so that the apparatus of FIG. 3 can condition larger quantities of tobacco per unit of time. Also, the distance between the top wall of the cover portion 162 and the bottom wall 152 is greater than in the conveyor 1 of FIGS. 1 and 2. Still further, the number of apertures 153 in the bottom wall 152 is less than the number of apertures 53. Consequently, the currents of air passing upwardly through the apertures 153 are still capable of agitating the tobacco particles but they are free to expand in the relatively high and wide cover portion 162 to thus prevent entrainment of tobacco particles into the conduit and outlet (not shown) serving to evacuate air from the rear and front sections of the conveyor 101. The combined cross-sectional area of all apertures 153 is preferably substantially less than one-fourth of the tobacco-supporting area of the bottom wall 152.

Figure 4:
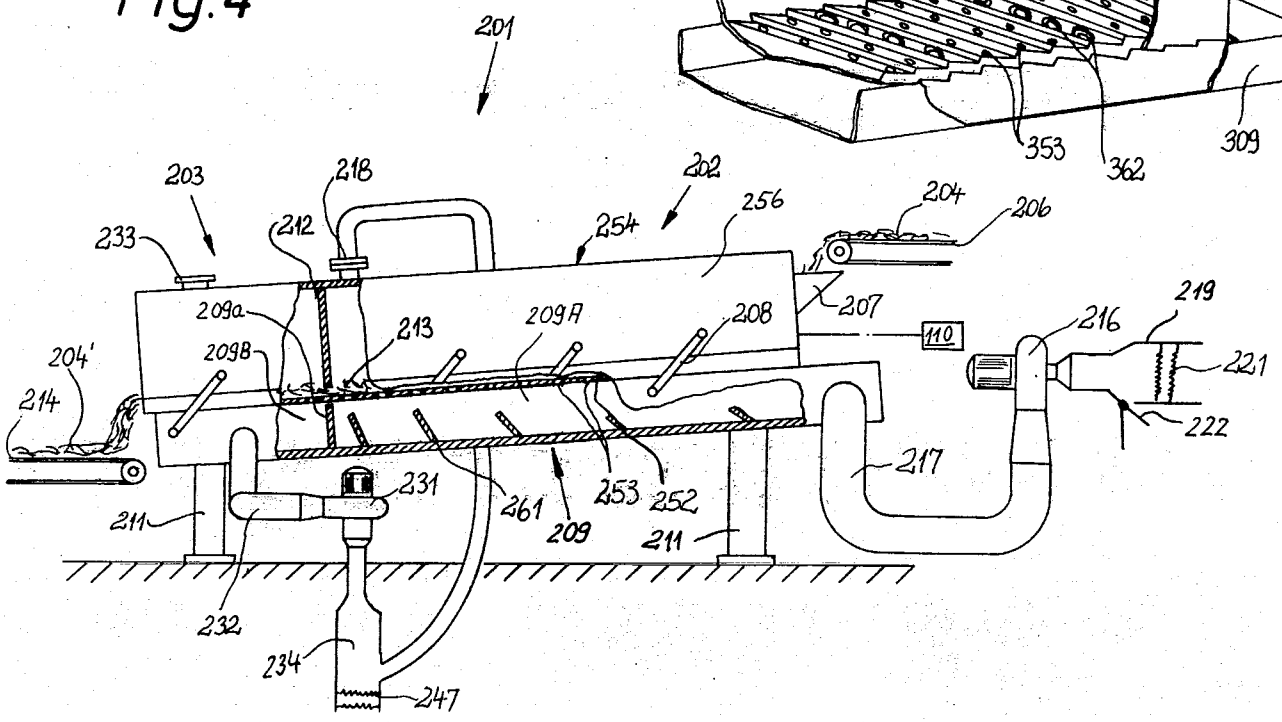
FIG. 4 is a partly elevational and partly longitudinal vertical sectional view of a third conditioning apparatus.

The conditioning apparatus of FIG. 4 comprises a vibratory conveyor 201 having sections 202, 203, a feeding conveyor 206 which delivers to the section 202 a continuous stream of tobacco particles 204, and a receiving conveyor 214 which is located at the discharge end of the conveyor section 203 and transports conditioned tobacco 204' to a further processing station, not shown. The section 202 serves for drying of tobacco and the section 203 is used to establish a hygroscopic balance between heated and dried tobacco and the surrounding atmosphere. The feeding conveyor 206 discharges tobacco particles 204 into a chute 207 for introduction into the conveyor section 202.

The casing of the vibratory conveyor 201 is mounted on a stationary chamber 209 by means of leaf springs 208 and is vibrated by a vibrator 210. The chamber 209 is mounted on stationary uprights 211. The casing of the conveyor 201 includes a transverse partition 212 which separates the section 202 from the section 203 and is provided with an opening 213 for passage of tobacco particles 204. The interior of the chamber 209 is subdivided into two compartments 209A, 209B by a transverse partition **209*a*. The upper side of the chamber 209** is open.

The compartment 209A below the conveyor section 202 receives heated air by way of a conduit 217 which is connected with the outlet of a blower 216. The inlet of the blower 216 is connected with a pipe 219 containing an electric resistance heater 221. The adjustable valve which can mix unheated atmospheric air with heated air in the pipe 219 is shown at 222. The space above the path of tobacco particles 204 in the section 202 is connected with an intercepting conduit 218 which evacuates air from the conveyor section 202 and supplies such air into a pipe 234 connected with the inlet of a second blower 231 serving to supply conditioned air into the compartment 209B by way of a pipe 232. The pipe 234 contains an electric resistance heater 247. Spent air can escape from the section 203 by way of an outlet 233.

The casing of the conveyor 201 comprises a stepped tobacco supporting member or bottom wall 252 which is inclined forwardly and downwardly, as considered in the direction of tobacco transport, and is provided with apertures 253. The apertures 253 are circular holes each having a diameter which preferably equals or approximates the thickness of the bottom wall 252. The combined cross-sectional area of apertures 253 is preferably less than one-fourth of the tobacco-supporting area of the bottom wall 252. The casing of the conveyor 201 further includes a cover portion 254 having side walls 256 which diverge in the same way as the side walls 56 shown in FIG. 2.

When the vibrator 210 causes the casing of the conveyor 201 to perform recurrent vibratory movements, the bottom wall 252 acts not unlike a diaphragm and pumps air through the apertures 253 for entry into the conveyor sections 202 and 203. The bottom wall 252 moves relative to the chamber 209 in the same way as described in connection with FIGS. 1 and 2, and the conditioning apparatus of FIG. 4 also comprises suitable sealing means to prevent uncontrolled escape of air at the upper end of the chamber 209.

The chamber 209 accommodates means for changing the intensities of air currents passing through the stepped bottom wall 252 of the casing of vibratory conveyor 201. The intensity varying means includes forwardly and upwardly inclined baffles 261 which are mounted on the bottom panel of the chamber 209 and extend transversely of the bottom wall 252. As shown in FIG. 4, the inclination of successive baffles 261 (as considered in the direction of tobacco transport through the conveyor 201) changes from baffle to baffle, i.e., the angle which successive baffles make with the general plane of the bottom wall 252 increases in a direction from the chute 207 toward the receiving conveyor 214. Each baffle 261 extends across the full width of the chamber 209. The baffles 261 insure that the pressure of air in successive zones of the compartment 209A rises from baffle to baffle, i.e., the speed of air currents which pass through the apertures 253 located nearer to the partition 212 is greater than the speed of air currents passing through apertures 253 which are more distant from the partition 212. The apertures 253 preferably form parallel rows extending transversely of the entire bottom wall 252.

The operation of the conditioning apparatus of FIG. 4 is as follows:

The feeding conveyor 206 delivers to the chute 207 a continuous stream of tobacco particles 204, and successive increments of such stream descend onto the vibrating bottom wall 252 above the compartment 209A of the chamber 209. The conduit 217 delivers heated air into the compartment 209A whereby such air passes through the apertures 253 of the bottom wall 252 in the conveyor section 202 to form small currents which agitate and remove moisture from tobacco particles 204. The baffles 261 direct heated air against the underside of the bottom wall 252. The air currents which enter the interior of the cover portion 254 in the conveyor section 202 are evacuated by way of the intercepting conduit 218 under the action of the blower 231. The baffles 261 constitute barriers for the flow of air in the compartment 209A toward the partition **209*a* and effect an acceleration of air which forms rapidly flowing currents capable of spreading tobacco particles 204 over the entire upper side of the bottom wall 252. The tobacco particles 204 which are being admitted by the chute 207 push the previously admitted tobacco particles across the air barriers formed by rapidly rising currents of air in the region of the baffles 261. This causes the formation of an undulate carpet of tobacco particles whose width equals the full width of the bottom wall 252 and which advances toward the opening 213 in the partition 212 to enter the conveyor section 203. The air barriers formed by rapidly flowing air currents passing through the apertures 253 which are located above the baffles 261 insure a highly satisfactory loosening of eventual accumulations or batches of tobacco particles so that the material passing through the opening 213 is a homogeneous stream of tobacco particles. Such loosening is desirable because it insures that each side of each discrete tobacco particle can exchange heat and moisture with air which rises into the cover portion 254 above the compartment 209A by flowing through the respective apertures 253 in the bottom wall 252.**

The stream of tobacco particles 204 is advanced forwardly (toward the receiving conveyor 214) while the bottom wall 252 rises, and such upward movements of the bottom wall 252 result in agitation of tobacco particles which are caused to repeatedly rise above and descend onto the upper side of the bottom wall 252 with the result that the energy exchange between tobacco and air which is furnished by the conduit 217 is highly satisfactory to thus guarantee rapid withdrawal of excess moisture. Whenever the bottom wall 252 descends under the action of the vibrator 210, it compresses the body of air in the chamber 209 whereby the pressure of air flowing through the apertures 253 increases still further. Such highly compressed air propels the tobacco particles above and away from the upper side of the bottom wall 252 to produce the aforementioned agitating and loosening action. The steps of the bottom wall 252 also promote the transport of tobacco particles 204 toward the discharge end of the conveyor section 203.

As mentioned before, the side walls 256 of the cover portion 254 diverge in a direction upwardly and away from the bottom wall 252. Therefore, the speed of air currents which have passed through the apertures 253 decreases and the currents are incapable of entraining tobacco particles into the intercepting conduit 218.

The condition of air in the compartment 209B preferably corresponds to the desired condition (temperature and moisture content) of tobacco 204'. The control unit which regulates the temperature and moisture content of air in the compartment 209B may be identical with the control unit 36 of FIG. 1. The same applies for the control unit which can regulate the temperature of air in the compartment 209A by changing the position of the valve 222 in the pipe 219. The moisture content of tobacco 204' on the receiving conveyor 214 can be monitored by a detector similar to or identical with the detector 29 of FIG. 1.

The baffles 261 insure that the particles of tobacco are spread across the entire upper side of the bottom wall 252 which allows for full utilization of all gas currents to bring about a rapid, uniform and intensive conditioning action.

Figure 5:
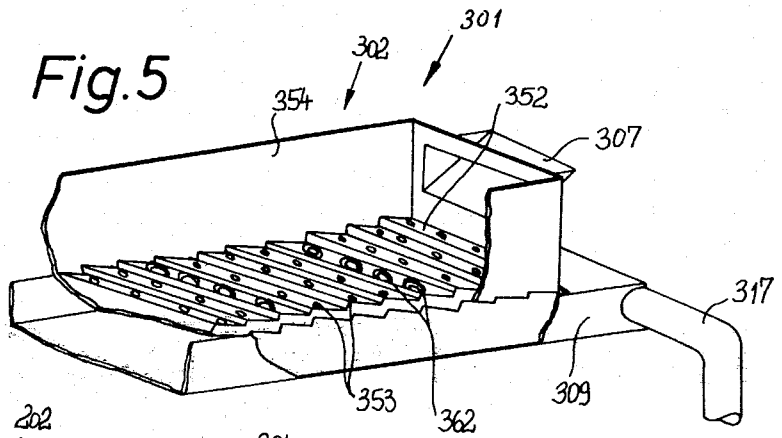
FIG. 5 is a fragmentary perspective view of a fourth conditioning apparatus.

The conditioning apparatus of FIG. 5 has a vibratory conveyor 301 whose stepped tobacco-supporting bottom wall 352 is provided with small apertures 353 and larger apertures 362. The baffles 261 of FIG. 4 are omitted. All other parts shown in FIG. 5 are denoted by reference characters similar to those employed to denote similar parts of the apparatus of FIG. 4. Thus, the chamber is shown at 309, the air admitting conduit at 317, the chute at 307, the cover portion of the conveyor casing at 354, and the rear section of the conveyor 301 at 302. The apertures 362 allow the passage of relatively large air currents which bring about a more pronounced agitation of corresponding portions of the tobacco layer in the conveyor 301. The apertures 362 (and preferably also the smaller apertures 353) form rows or groups which extend transversely of the bottom wall 352 to bring about a uniform distribution of tobacco particles across the full width of the conveyor 301.

The means for vibrating the conveyor 301 is not shown in FIG. 5.

An important advantage of our method is that the pulsating currents of air insure a desirable loosening of tobacco particles in the vibratory conveyor to thus promote a uniform and intensive heating and drying action. This renders it possible to reduce the overall size of the conditioning apparatus and to condition large quantities of tobacco per unit of time. Moreover, the aforediscussed configuration of the bottom wall of casing of the vibratory conveyor and the distribution of apertures in the bottom wall insure that the layer of tobacco in the vibratory conveyor forms a carpet which overlies the entire apertured bottom wall even if all portions of the casing of the vibratory conveyor do not vibrate at the same amplitude. The apertures of varying size (FIG. 5) and the baffles (FIG. 4) also contribute to a more pronounced agitating action and to a more uniform heating and conditioning action.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. A method of conditioning tobacco, comprising the steps of transporting a continuous stream of tobacco particles in a predetermined direction along a predetermined support path; passing across said path ascending currents of a gaseous fluid whereby the particles of tobacco exchange energy with said gaseous fluid and at least some particles of the stream float in the fluid which crosses said path; vibrating the particles of said stream and pulsating said currents, at least during crossing of said path, to thereby promote the exchange of energy between tobacco and the fluid and to effect a loosening of the constituents of said stream; and reducing the speed of ascending currents in the course of energy exchange with the particles of said stream to thereby prevent the ascending fluid from entraining appreciable quantities of tobacco particles above and away from said path.

2. A method as defined in claim 1, wherein said fluid is air and said last mentioned step comprises gradually reducing the speed of ascending air currents in the course of energy exchange with the particles of said stream.

3. A method as defined in claim 1, wherein said currents include at least one first group of currents flowing at a first speed and at least one second group of currents flowing at a different second speed.

4. A method as defined in claim 1, wherein said currents include at least one first group of currents each having a first cross-sectional area and at least one second group of currents each having a different second cross-sectional area.

5. A method as defined in claim 1, wherein said path has a predetermined width and said currents are distributed across the full width of said path.

6. A method as defined in claim 1, wherein said path includes a first portion and a second portion, said currents including a first group of currents passing across said first portion of said path and a second group of currents passing across said second portion of said path, and further including the step of heating one of said groups of currents to a predetermined temperature exceeding the temperature of tobacco particles in the respective portion of said path.

7. A method as defined in claim 6, further comprising the step of maintaining the temperature and the moisture content of the other group of currents at a predetermined value.

8. A method as defined in claim 6, further comprising the step of intercepting the gaseous fluid of said one group of currents subsequent to passage of said one group of currents across the respective portion of said path and utilizing the thus intercepted fluid to form said other group of currents.

9. A method as defined in claim 1, wherein said path slopes downwardly, as considered in said direction.

* * * * *